US006082646A

United States Patent [19]

Clarke et al.

[11] Patent Number: 6,082,646

[45] Date of Patent: Jul. 4, 2000

[54] FASTENING SYSTEM FOR LINER ASSEMBLIES OF ORE MILLS

[75] Inventors: Ronald C. Clarke, Phoenix, Ariz.; Gary G. Edwards, Blaine; Jeffrey H. Washburn, Shoreview, both of Minn.

[73] Assignee: ME International, Minneapolis, Minn.

[21] Appl. No.: 09/348,778

[22] Filed: Jul. 7, 1999

[51] Int. Cl.[7] ..... B02C 17/22

[52] U.S. Cl. ..... 241/182; 241/183; 241/300

[58] Field of Search ..... 341/181, 182, 341/183, 284, 299, 300

[56] References Cited

U.S. PATENT DOCUMENTS

| | | | |
|---|---|---|---|
| 3,107,867 | 10/1963 | Svensson et al. | 241/183 |
| 3,186,650 | 6/1965 | Dixon et al. | 241/183 |
| 3,582,007 | 6/1971 | Heighberger | 241/183 |
| 4,018,393 | 4/1977 | Larsen | 241/182 |
| 4,583,575 | 4/1986 | Lundmark | 241/183 X |
| 5,055,336 | 10/1991 | Davis | 241/183 X |
| 5,516,051 | 5/1996 | Brisbois et al. | 241/172 |
| 5,752,665 | 5/1998 | Wason | 241/299 |

*Primary Examiner*—John M. Husar

*Attorney, Agent, or Firm*—Merchant & Gould P.C.

[57] ABSTRACT

A segmented liner assembly and liner segment fastening system is disclosed for the rotatable shell of an ore grinding machine, the shell having a plurality of mounting bores formed therethrough. The liner assembly consists of a plurality of liner segments each of which has one mounting bore that extends into the body of the segment from its mounting surface and a mounting recess having a transverse size greater than that of the mounting bore which extends from the mounting bore to the grinding surface. A threaded member extends through a mounting bore of the shell and an aligned mounting bore of the segment into the recess of the segment and externally of the shell. The threaded member is screwed into a nut that is seated at the base of the mounting recess. In a first embodiment, the threaded member has an integrally formed wrenching head enabling the threaded member to be rotated and screwed into the nut, thus drawing the liner segment tightly against the inner surface of the shell. In a second embodiment, rather than a wrenching head, a second nut is used externally of the shell and the end of the threaded member has a smaller wrenching portion. In either case, when removal of the liner assembly is necessary for replacement, the threaded member is reverse rotated to remove it from the internal nut, enabling the liner segment to be removed.

13 Claims, 6 Drawing Sheets

FASTENING SYSTEM FOR LINER ASSEMBLIES OF ORE MILLS

The invention broadly relates to segmented liner assemblies for ore comminuting or grinding machines, and is specifically directed to an improved system for fastening segmented liners to the rotatable shell of an ore grinding machine.

When ore is mined it is generally in very large fragments that must be reduced in size for further refining. Several types of ore comminuters or reducers may be used, one of which takes the form of a large cylindrical closed drum that is rotated on a horizontal axis. Ore is introduced into one end of the drum through an inlet, and after reduction or comminution, the reduced ore is discharged through an outlet in the opposite end. Within the drum, the charge of ore fragments rests at the bottom of the rotating drum. As the drum rotates, part of the ore charge is carried upwardly along the irregular inner surface of the drum until the carried fragments drop from the drum surface due to gravity, tumbling back onto the ore charge and breaking the fragments. This continuous process results in reduction of the fragments to a predetermined size, at which time they are discharged from the mill.

The inner cylindrical surface of the drum is fitted with a liner assembly made up of individual liner segments arranged in circumferential and axial rows. The liner segments are cast from alloys that are optimized to increase the wear rate while avoiding breakage by being too hard and brittle. Each of the liner segments has a slightly convex bottom surface that conforms to the radius of curvature of the cylindrical drum and a top surface that is irregular in shape. The liner segments together typically define axially extending ridges and valleys that facilitate lifting of the ore fragments as the drum is rotated.

Ore comminuting mills of this type generally run 24 hours a day for economic efficiency. The continuous process wears the liner segments down over a period of time, which will depend on the type of ore and application, after which the liner assembly must be replaced. Because down time of the ore comminuting mill adversely effects the economic efficiency of the process, it is essential to change the liner assembly as quickly as possible.

Liner segments are conventionally fastened to the cylindrical shell by casting transverse mounting bores that extend from the grinding surface to the mounting surface. Each segment may include three such mounting bores. The cylindrical shell has a like number of mounting bores that are similarly spaced, permitting the mounting bores of the segments to be positioned in alignment. Once aligned, bolts are passed from the inside of the shell through the liner segments and the aligned mounting bores in the shell to project externally of the shell. A nut and sealing washer are threaded onto and tightened from outside the shell, drawing the liner segment tightly to the inner surface of the shell. An example of a conventional segment fastening system is shown in U.S. Pat. No. 4,018,393 issued Apr. 19, 1977.

This type of segment fastening system works quite well in installing the liner assembly. However, the bolt heads are usually exposed at least partially to the comminution process, and by the time the segments require replacement they may be severely deformed as are the exposed bolt heads. The continuous bombardment of fragments usually causes peening of the casting immediately around the bolt head which may occlude the head and reduce its accessibility for removal.

In addition, there is necessarily at least some minimal space between the sides and ends of adjacent liner segments to permit installation. During the ore comminution process, ore fines tend to fill up these spaces and are compacted in place, and the liner segments may also be peened onto each other. The consequence of all of this is significant difficulty in removing the compacted liner segments when replacement is necessary. While the external nuts on the mounting bolts may be removed relatively easily, this does not release the individual segments because of such compacting. Further, the bolts themselves have significant shear forces placed on them during the ore comminution process, often causing deformation to the point that they become skewed and tightly lodged within the mounting openings of the cylindrical shell.

Segment replacement involves removal of the nuts, typically followed by hammering the exposed bolt from outside the mill. The force necessary to remove a particular segment often necessitates utilization of a crane that carries a heavy hammering implement in a pendulum manner.

Another approach that may be used instead of or in addition to externally hammering the bolts is torch cutting the segments from within the shell to gain access to the bolts. If the bolt head can be effectively reached by torch cutting, the bolt may be removed either by forcing it inside or outside the shell, and this facilitates segment removal.

As will be appreciated, the conventional fastening of liner segments results in difficult segment removal when replacement is necessary, and this in turn causes significant mill down time.

Our invention is the result of an endeavor to develop a segment fastening system that makes segment installation and removal much easier and much less time consuming. The basic concept is to provide a system in which the stem of the bolt can be removed from outside the shell at the time of removal. As indicated, if the bolt can be removed, this leaves only the compacting of the segments with each other to be dealt with, which usually is a lesser problem.

In a first embodiment of our invention, each of the individual segments is cast or otherwise formed with mounting bores of predetermined transverse size that extend into the body of the liner segment from the mounting surface. A recess of greater transverse size than the mounting bore extends from the segment grinding surface to the bore. With the liner segment in place with its mounting bores aligned with the mounting bores of the cylindrical shell, a threaded bolt is inserted from outside the shell through the aligned mounting bores. A nut is inserted into the mounting recess from inside the shell. The mounting recess and nut are the same configuration, and preferably oblong or otherwise non-circular to keep the nut from rotating within the recess. The bolt is then threadably inserted into the nut from outside the cylindrical shell and tightened until the bolt head and associated sealing washer bear against the external surface of the shell.

The particular application may require that the individual mounting recesses of the liner segment be relatively deep. To facilitate the fastening process, a T-shaped tool having a threaded end may be used. Prior to insertion, the nut is screwed onto the threaded end of the tool, inserted down into the recess and held in place until the internally projecting bolt may be screwed into it. The T-shaped tool is then unscrewed from the nut and removed, at which time the bolt may be tightened.

At the time of segment replacement, the bolt head may be reverse rotated to disengage it from the nut and remove it entirely from the cylindrical shell, after which removal of the unfastened segment is simplified.

In the second embodiment, a headless threaded stem or rod having a small hexagonal end is used in place of the bolt.

An internal fastening nut is first screwed onto the threaded rod and dropped into the recess with the rod projecting through the mounting bores of the segment and shell and then externally of the shell. A sealing washer and a nut are then placed on the threaded rod from outside the shell and tightened to draw the segment to the shell. This considerably simplifies the installation procedure relative to the existing practice.

For removal, the external nut is unscrewed from the rod and the sealing washer removed, and a wrench is placed on the hexagonal rod end to unscrew it from the internal nut. The rod is then withdrawn, after which the unfastened segment can be removed.

In both embodiments, a plug preferably formed from plastic such as urethane is inserted into the mounting recess of the liner segment. The plug is configured to be frictionally inserted by pounding it in, but is difficult to remove. It substantially fills the recess, thus protecting the internal nut during the ore grinding process, by preventing fragments and fines from entering the recess. In so doing, damage to the internal nut is reduced, which increases the likelihood of a simple removal of the liner segment after the mounting rods have been removed.

The various features of the invention will be more fully appreciated from the specification and drawings.

DETAILED DESCRIPTION OF THE PREFERRED EMBODIMENT

Figure 1:
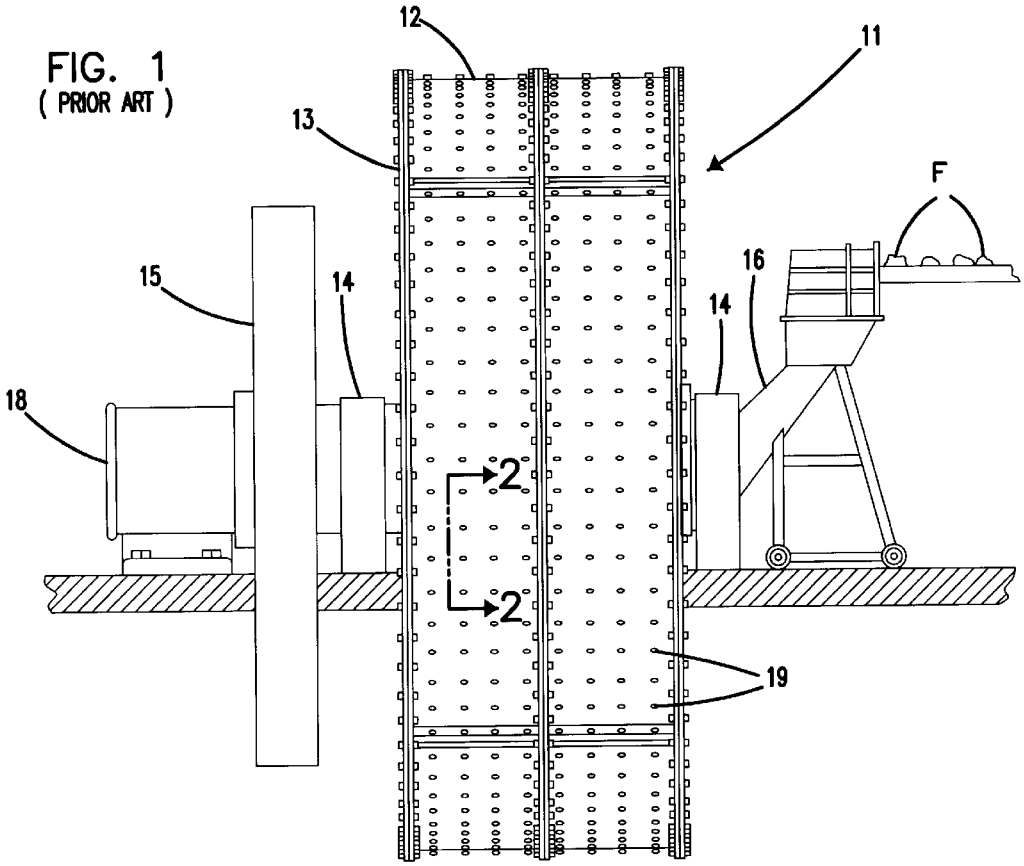
FIG. 1 ( PRIOR ART )
FIG. 1 is a generally schematic view in side elevation of an ore comminuting machine.

With initial reference to FIG. 1, an ore comminuting machine or grinding mill 11 is shown with which the inventive liner assembly and fastening system are used. Grinding mill 11 comprises a hollow drum or shell, closed by end walls 13 having large central apertures, and arranged for rotation about a substantially horizontal axis through suitable bearings 14 by a drive of conventional nature disposed in the housing 15. Ore fragments F are supplied to an inlet chute 16 which guides the fragments F into the grinding mill 11. After size reduction as the result of ore grinding, the comminuted material is discharged from the outlet end 18.

Figure 2:
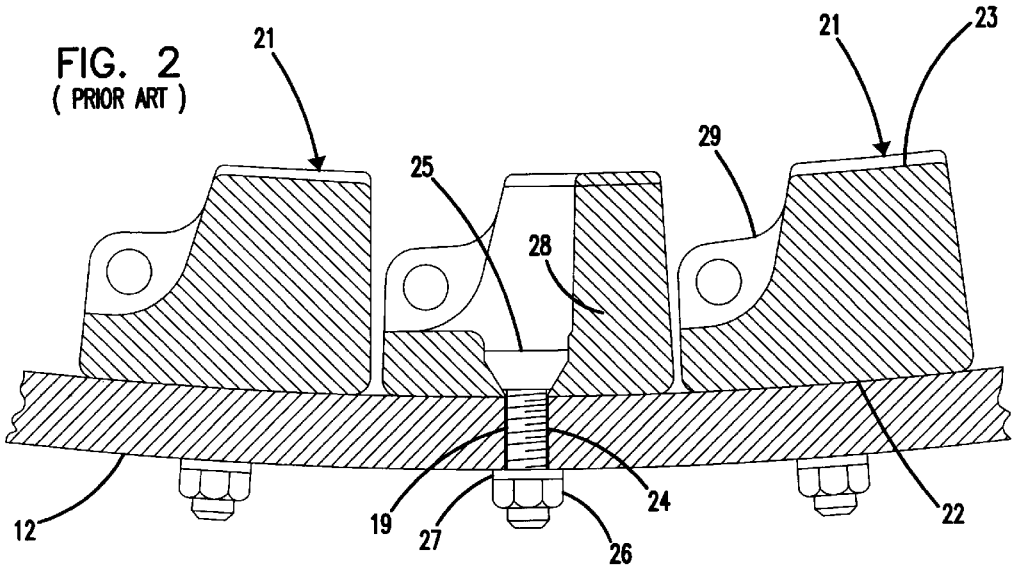
FIG. 2 ( PRIOR ART )
FIG. 2 is an enlarged fragmentary transverse sectional view taken along the line 2—2 of FIG. 1 showing portions of a segmented liner assembly for the ore comminuting machine and a fastening system therefor.
Figure 3:
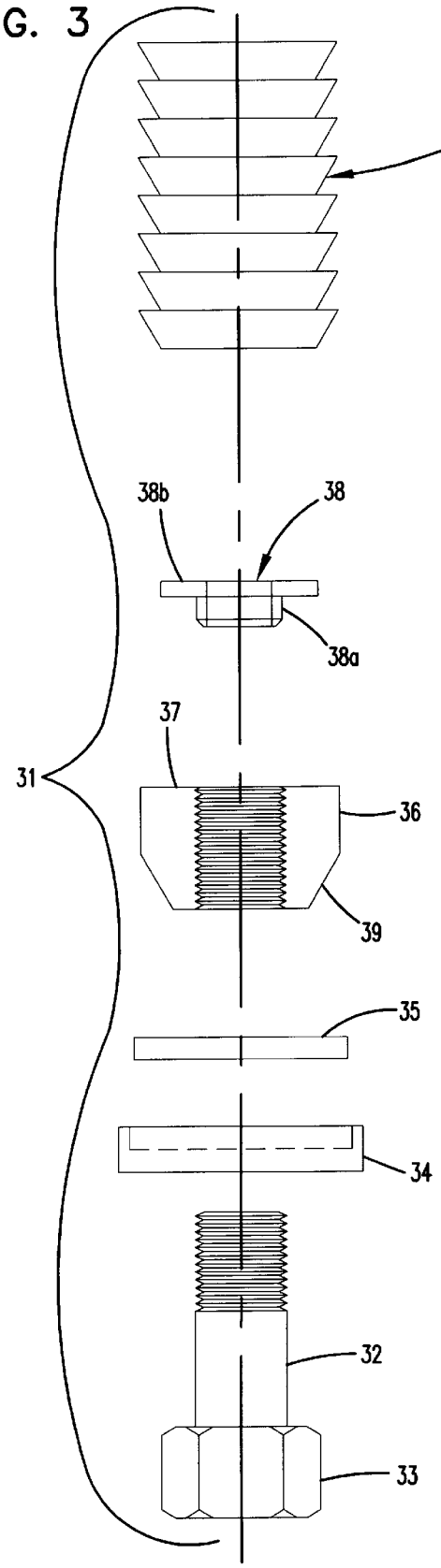
FIG. 3 is an exploded view in side elevation of an improved fastening system for the liner segments of a segmented liner assembly.
Figure 4:
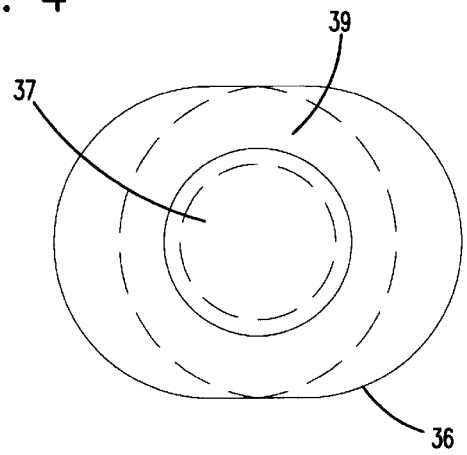
FIG. 4 is an enlarged view in top elevation of a nut component used in the fastening system of FIG. 3, portions thereof being shown in phantom.
Figure 5:
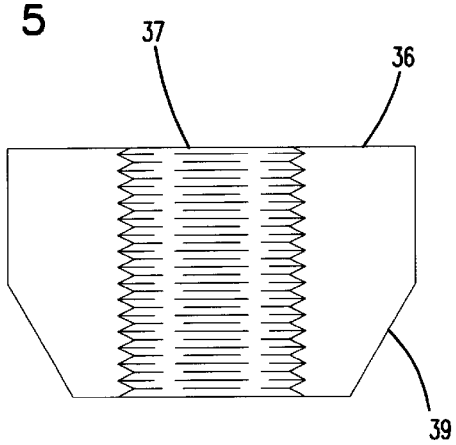
FIG. 5 is a transverse sectional view inside elevation of the nut component of FIG. 4.

With continued reference to FIGS. 1 and 2, the cylindrical portion of shell 13 is formed with circumferential and axial rows of mounting bores 19 that are used to fasten individual liner segments of a liner assembly. FIG. 2 discloses an exemplary prior art segmented liner assembly consisting of individual liner segments 21 each of which defines a mounting surface 22 that is slightly convex to conform to the radius of curvature of the inner cylindrical surface of shell 12, and a grinding surface 23 which is irregular in configuration. When installed, the segments define axially extending ridges and valleys on the inner shell surface. As the shell 12 rotates in the direction shown by the arrow in FIG. 2, ore fragments F are circumferentially lifted from the ore charge until they reach a point at which they fall from the shell and back onto the ore charge, thus reducing the size of the ore fragments F.

With continued reference to FIG. 2, each of the conventional liner segments 21 is secured to the shell 12 by a nut and bolt assembly consisting of a bolt 24 having an enlarged head 25, a nut 26 and a sealing washer 27. The bolt 24 extends through one of the mounting bores 19 of shell 12 with the enlarged tapered head 25 seated against a tapered recess 28 formed in the base of segment 21.

Each of the segments 21 is formed with a lifting eye 29 which facilitates the installation process.

The liner segments 21 are typically cast from pearlitic steel or martensetic white iron, or iron chosen to maximize the wearing characteristic of the segment 21 while avoiding breakage due to brittleness.

During operation of the grinding mill 11, the constant process of lifting ore fragments to a higher point and dropping them on the ore charge has the effect of deforming the tapered bolt head 25 over time. Often the bolt head 25 is disfigured by peening, as is the region of the segment 21 immediately surrounding the recess 28. As a consequence, it becomes extremely difficult to extract bolts 24 when the liner segments 21 become worn to the point of requiring replacement. Often it becomes necessary to torch cut the liner segments 21 to gain access to the bolt 24 so that the segment can be removed and replaced.

Fastening systems such as the one shown in FIG. 2, in which the bolt head 25 is disposed on the inner side of the shell 12 with the fastening nut 26 on the external mounting surface, have long been the conventional approach of fastening.

With reference to FIGS. 3–6, an improved fastening system for liner segments is represented generally by the numeral 31. Fastening system 31 comprises a threaded bolt 32 having an integral hexagonal head 33, a cup washer 34 and a rubber seal washer 35. Bolt 33 threads into a nut 36 that is preferably non-circular and specifically oblong. Nut 36 has an axial threaded bore 37 that extends therethrough and a tapered undersurfaces 39. A plastic thread protector 38 has a shallow shank 38*a* sized to fit into the threaded bore 37 and an enlarged flange 38*b* that bears against the top of nut 36.

Figure 6:
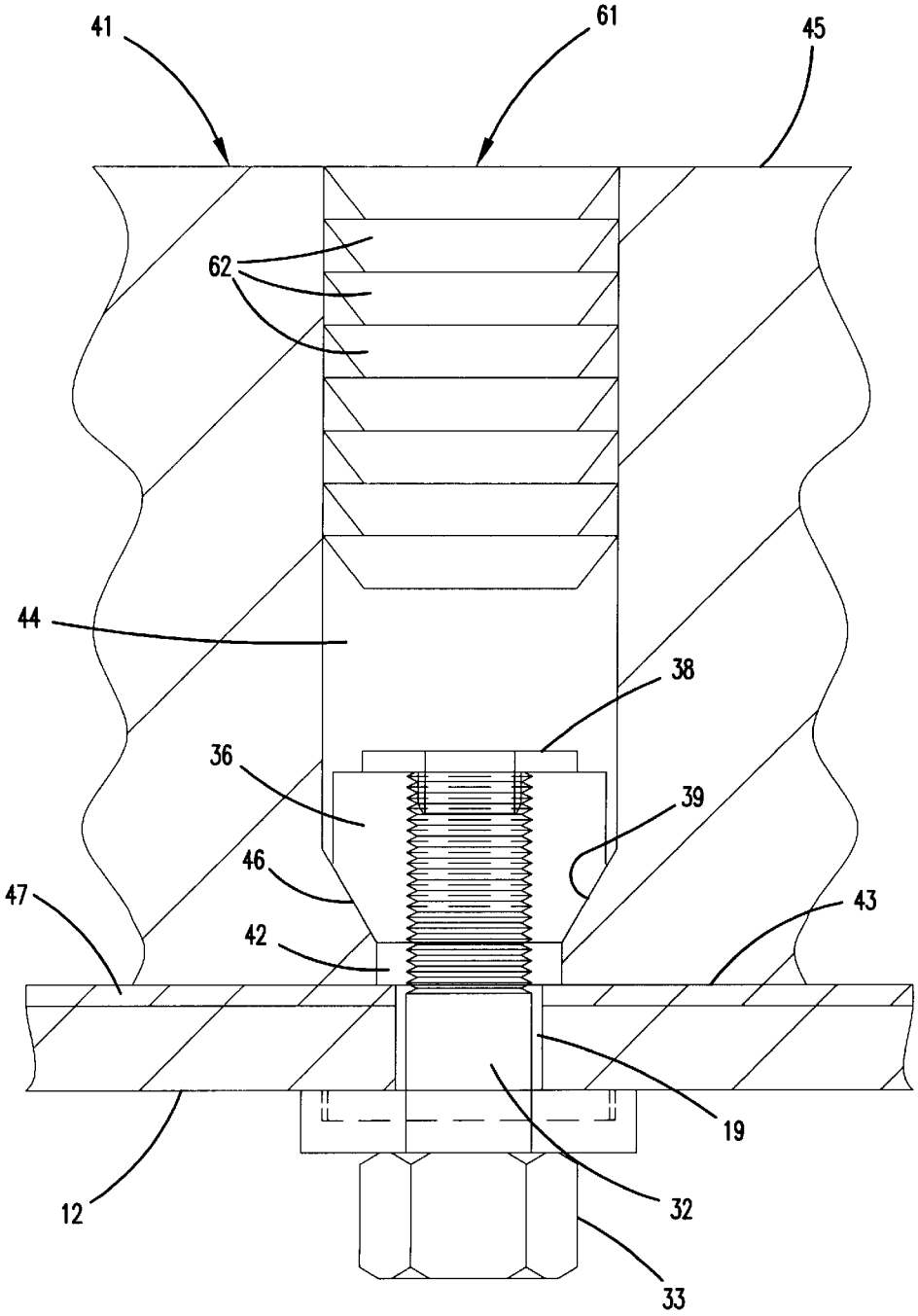
FIG. 6 is a fragmentary sectional view of a liner segment mounted to the rotating shell of the ore comminuting machine utilizing improved fastening system.

With specific reference to FIG. 6, a liner segment 41 is formed with a two or more mounting bores 42, all of which extends into the body of the segment 41 from a mounting surface 43. The mounting bore 42 is alignable with the mounting bore 19 of shell 12. Preferably, it is slightly larger in diameter for easier location.

Segment 41 is also formed with a recess 44 that is larger in transverse size than the mounting bore 42 and which extends from the mounting bore 42 to a grinding surface 45 of segment 41.

While mounting bore 42 is circular in transverse configuration, recess 44 preferably corresponds in configuration to nut 36; i.e., it is non-circular and preferably oblong although slightly larger in transverse size. Recess 41 tapers to bore 42 through a tapered surface 46 that mates with the tapered surface 39 of nut 36.

Figure 7:
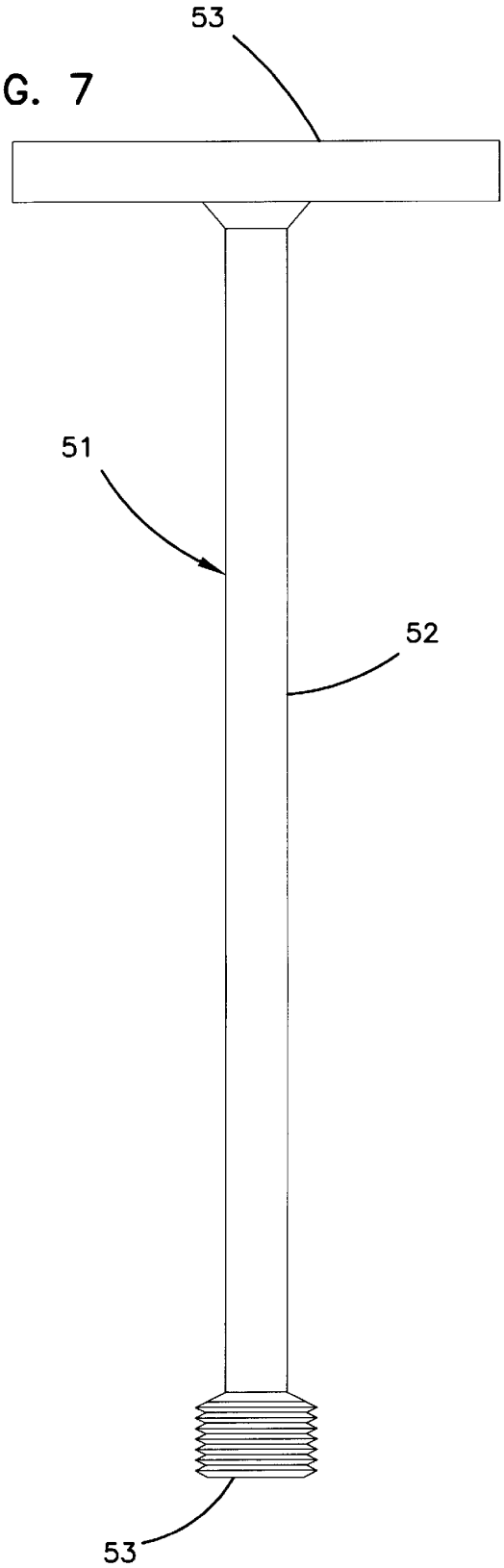
FIG. 7 is a view inside elevation of a tool for installing the segmented liner assembly.
Figure 8:
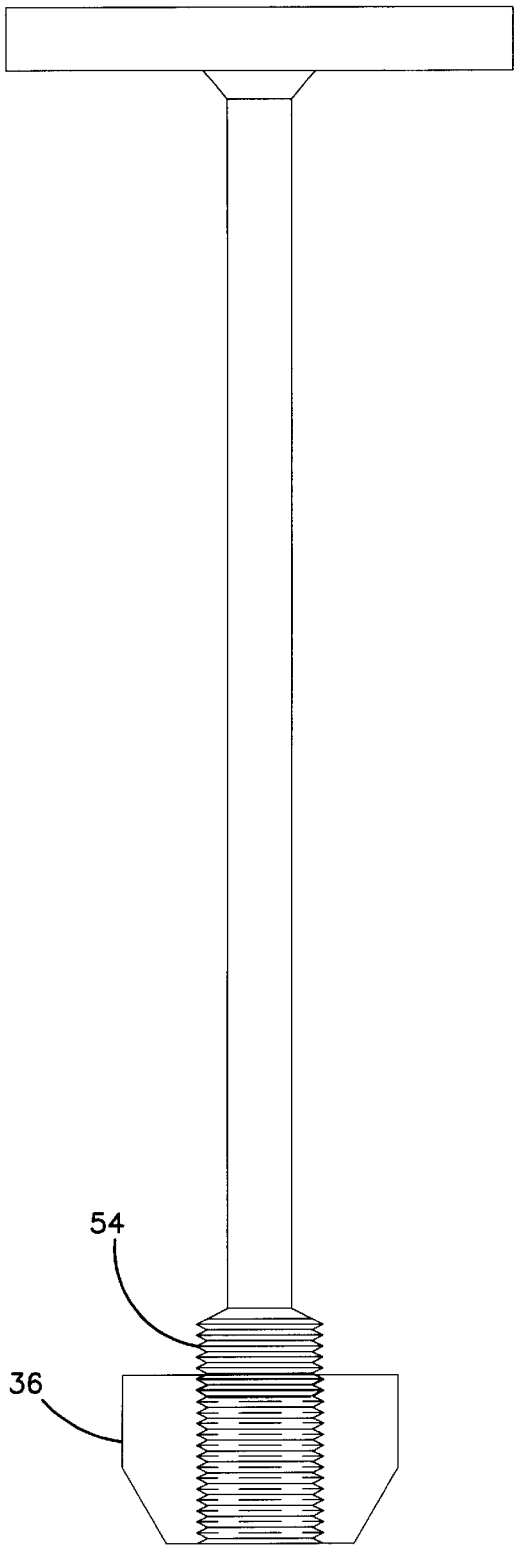
FIG. 8 is a view inside elevation of the installation tool threadably connected to a nut component.
Figure 9:
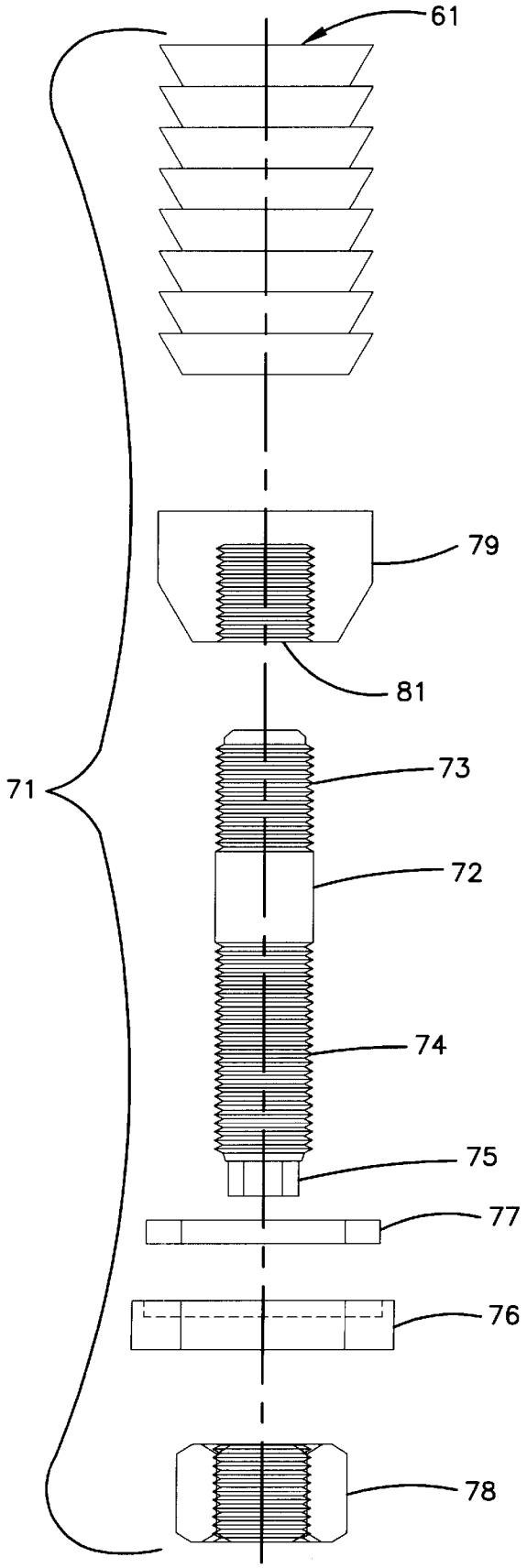
FIG. 9 is an exploded view inside elevation of an alternative embodiment of the improved fastening system.

In the installation of liner segments 41 using the fastening system 31, the segment 41 is placed onto shell 12 which may have a rubber backing layer 47, with mounting bore 42 aligned with an appropriate mounting bore 19. Because of the depth of recess 44, proper placement of the nut 36 to receive bolt 32 is difficult. Consequently, and with reference to FIGS. 7 and 8, an installation tool bearing general reference numeral 51 may be utilized. Tool 51 consists of an elongated shaft 52 having upper and lower ends, with a transverse handle 53 attached to the upper end. A threaded plug 54 is secured to the lower end of shaft 52, the threads and size of which are chosen for threadable engagement with nut 36 as shown in FIG. 8. For installation, nut 36 is threaded onto plug 53 only a small distance as shown.

Shaft 52 is sufficiently long to permit insertion of the nut 36 to the bottom of recess 44 and bore 42 with transverse handle 53 projecting well above the liner segment 41. With the nut 36 so inserted by one installer from the inside of mill 11, a second installer may insert a bolt 32, with washers 34, 35 properly placed on its shank, through bores 19 and 42 and screwed into the nut 36. As soon as threadable engagement occurs, the installation tool 51 may be unscrewed since nut 36 cannot itself rotate due to its oblong configuration. Bolt 32 can then be rotated by a wrench to draw nut 36 and liner segment 41 tightly against layer 47 and shell 12.

To protect the threaded bore 37 of nut 36, thread protector 38 is then force fit into the threaded bore 37. The flange **38*b* of protector 38 is solid, thus preventing ore fragments and fines from entering the bore 37**.

With continued reference to FIG. 6, a plug 61 is inserted into the mounting recess 44 to protect nut 36 and the internally projecting end of bolt 32. The cross sectional configuration of plug 61 corresponds to the mounting recess 44 and nut 36 as shown on FIG. 4. However, it is dimensioned to be slightly greater in size than the mounting recess 44.

In the preferred embodiment, plug 61 is injection molded from urethane. It defines a plurality of coaxial barbed segments 62 each of which is angled to facilitate insertion into the mounting recess 44. As configured, and being slightly oversized relative to the mounting recess 44, plug 61 can be initially into the recess 44 and then pounded into place until its top surface is even with the grinding surface 45 of liner segment 41.

As grinding takes place, liner segment 41 is continuously worn away as is plug 61. However, plug 61 remains firmly in place to continue protection of the nut 36 and bolt 32. When liner segment 41 wears to the point that plug 61 no longer exists, it is time for replacement of the segment 41. Stated otherwise, the length of plug 61 can be chosen to correspond to the effective wear thickness of liner segment 41, thus indicating by its absence when the liner assembly should be removed and replaced.

Plug 61 can be formed from different materials and take different structural forms, the primary objectives being that it take the same transverse configuration as mounting recess 44, that it fill the cross section of mounting recess 44 to fully protect the nut 36 and bolt 32, and that it include structural means for retaining it in the mounting recess 44 during the ore grinding process.

A second embodiment of the inventive fastening system is shown in FIGS. 9–12. With initial reference to FIG. 9, a fastening system 71 comprises a rod or stem 72 having an upper threaded end 73 and a lower threaded end 74 terminating in a hexagonal wrenching end 75 the transverse dimension of which is less than that of the threaded portion 74.

The fastening system 71 also comprises a cup washer 76 and rubber seal washer 77. An external mounting nut 78 is sized and threaded to screw onto the lower threaded portion 74.

An internal nut 79 has a blind threaded bore 81; i.e., threaded bore 81 does not extend axially entirely through the nut 79.

Fastening system 71 may also include a plug 61 for the same purpose as described above in connection with the embodiment of FIGS. 3–8. However, it is to be understood that the plug 61 is not an integral portion of either of the fastening systems 31, 71, and that the plug 61 may be used for different liner segments and liner assembly fastening systems.

Figure 10:
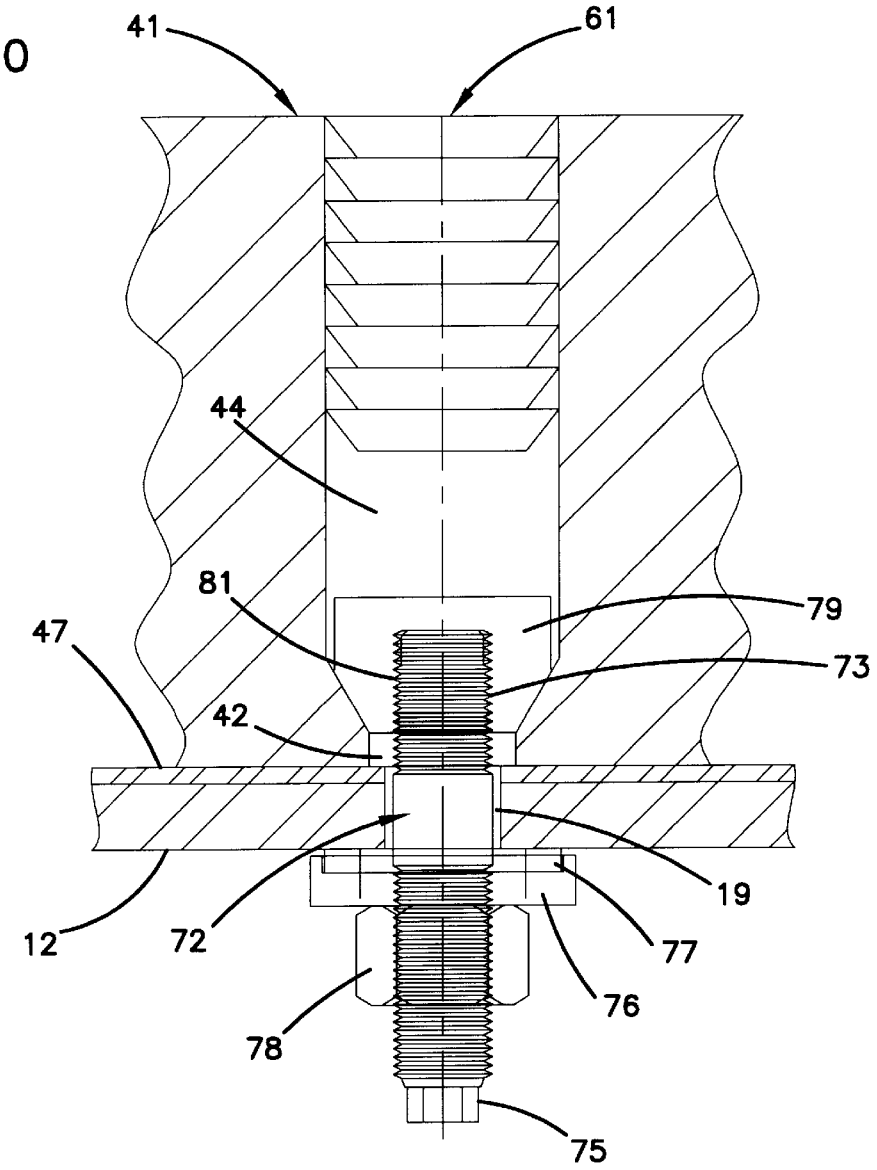
FIG. 10 is a fragmentary sectional view of a liner segment mounted to the rotatable shell of the ore comminuting machine utilizing the improved fastener system.
Figure 11:
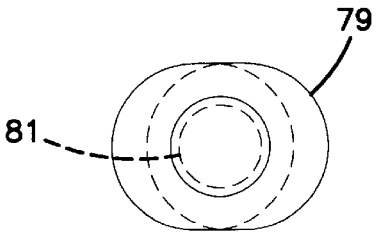
FIG. 11 is a view in top plan of a nut component for the fastening system of FIGS. 9 and 10, portions thereof shown in phantom.
Figure 12:
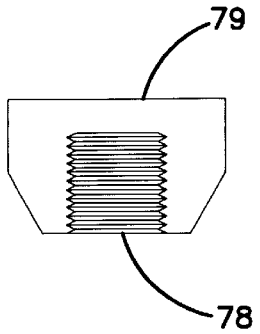
FIG. 12 is a transverse sectional view inside elevation of the nut component.

With additional reference to FIGS. 10–12, the fastening system 71 is intended to be used with the same type of liner segment 41, and like numerals are therefore used in these figures.

In the mounting of a liner assembly onto a cylindrical shell 12 having a rubber backing layer 47, a liner segment 41 is initially placed with its mounting bores 42 aligned with the mounting bores 19 of shell 12. At this point, an internal nut 79 is threaded onto the upper threaded portion 73 of the stem or rod 72. The rod 72, with the nut 79 affixed, is dropped into the mounting recess 44 so that the rod 72 projects through mounting bores 42, 19 and externally of the shell 12. A cup washer 76 and seal washer 77 are then placed over the rod 72 and an external mounting nut 78 is threaded onto the rod 72. The external fastening nut 78 is tightened by a wrench, drawing the liner segment 41 tightly against the rubber backing layer 47 and shell 12.

Because the threaded bore 81 of nut 79 is blind or dead ended, it is not possible for fragments and fines to impact the threaded portions of the system 71, which avoids problems in this respect. A plug 61 may be pounded into the recess 44 as shown in FIG. 10 to protect the fastening system 71 during the wear life of the liner segment 41.

After all of the fastening systems 71 for a particular liner segment 41 are installed, adjacent liner segments 41 can be mounted until the entire liner assembly is in place.

When replacement of a worn liner assembly is necessary, the external nut 78 is first removed together with the washers 76, 77. At this point, a wrench may be applied to the hexagonal lower end of rod 72 and reverse rotated to be unscrewed from the nut 79. Again, nut 79 cannot itself rotate do to its non-circular configuration within the mounting recess 44.

When the rod 72 has been removed, there is nothing holding the liner segment 41 in place except for the compacting that has occurred in and around the spaces defined between adjacent segments 41. However, since the rods 72 have all been removed, dislodging and removing the liner segments 41 is simplified and much quicker.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A segmented liner assembly and liner segment fastening system for the rotatable shell of an ore grinding machine, the shell having a plurality of mounting bores therethrough, comprising:

a plurality of liner segments each having a mounting surface engageable with the internal surface of the rotatable shell and a grinding surface;

each liner segment comprising at least one mounting bore of predetermined transverse size and extending into the body of the liner segment from the mounting surface, the mounting bore of the liner segment being alignable with a mounting bore of the rotatable shell, each liner segment further comprising a recess of greater transverse size than the mounting bore and extending from the mounting bore to the grinding surface;

a threaded member insertable through a mounting bore of the rotatable shell into an aligned mounting bore and recess of the liner segment;

a head member on the threaded member disposed to bear against the external surface of the rotatable shell;

the threaded member comprising a rod with first and second ends and having a threaded portion at each of said ends;

the head member comprising a second nut member threadable onto said second end; and a first nut member sized and configured to fit into said recess and having a threaded bore to threadably receive the threaded member, the first nut member being threadable onto said first end of the threaded member the threaded member being removable from the first nut member and shell by reverse rotation externally of the shell.

2. The liner assembly and segment fastening system defined by claim 1, wherein the nut member and mounting recess are relatively configured so that the nut cannot be rotated when disposed in the mounting recess.

3. The liner assembly and segment fastening system defined by claim 2, wherein the transverse configuration of the mounting recess and nut member are non-circular.

4. The liner assembly and segment fastening system defined by claim 3, wherein the transverse configurations of the mounting recess and nut member are oblong.

5. The liner assembly and segment fastening system defined by claim 4, wherein the base of the mounting recess and the undersurface of the nut member are tapered to define a seat.

6. The liner assembly and segment fastening system defined by claim 1, wherein the threaded bore of the nut member extends axially through the nut member, and further comprising a thread protecting plug member insertable into the end of the threaded bore.

7. The liner assembly and segment fastening system defined by claim 6, wherein the thread protecting plug member comprises a shank member sized for frictional insertion to and retention within said threaded bore, and a flange member carried by the shank member sized to overlie said threaded bore.

8. The liner assembly and fastening system defined by claim 1, which further comprises a protecting plug for the mounting recess to protect the threaded and nut members, the protecting plug being configured for insertion into the open end of the mounting recess at its juncture with the grinding surface of the liner segment, the protecting plug being configured to substantially the fill the transverse configuration of the mounting recess.

9. The liner assembly and segment fastening system defined by claim 8, wherein the transverse configuration of the mounting recess and protecting plug are substantially the same, the protecting plug having a slightly larger transverse dimension than that of the mounting recess to permit a frictional fit therebetween.

10. The liner assembly and segment fastening system defined by claim 1 wherein:

the rod further comprises a wrenching portion disposed approximate said second end.

11. The liner assembly and segment fastening system defined by claim 10, wherein the threaded portion of the second end is of predetermined transverse size, and the wrenching portion comprises a hexagonal member disposed on said second end and having a transverse dimension that is no greater than that of the threaded portion.

12. The liner assembly and segment fastening system defined by claim 1, wherein the threaded bore of the first nut member is blind.

13. The liner assembly and segment fastening system defined by claim 1, which further comprises a sealing member disposable on the threaded member between the head member and external surface of the shell and sealably engageable with said shell external surface.

* * * * *